United States Patent [19]

Rampe

[11] 4,059,926

[45] Nov. 29, 1977

[54] CHAIN FINISHING SYSTEM

[75] Inventor: John F. Rampe, Mayfield Heights, Ohio

[73] Assignee: Rampe Research, Cleveland, Ohio

[21] Appl. No.: 696,558

[22] Filed: June 16, 1976

[51] Int. Cl.[2] ..... B24B 31/06

[52] U.S. Cl. ..... 51/163.1; 51/313; 118/419

[58] Field of Search ..... 51/163.1, 7, 313–316; 118/419

[56] References Cited

U.S. PATENT DOCUMENTS

| | | | |
|---|---|---|---|
| 1,489,076 | 4/1924 | Harter | 118/419 |
| 1,935,995 | 11/1933 | Roemer | 118/419 X |
| 2,933,410 | 4/1960 | Brightly | 118/419 X |
| 3,792,552 | 2/1974 | Isaacson | 51/163.1 |

FOREIGN PATENT DOCUMENTS

| | | | |
|---|---|---|---|
| 1,167,689 | 4/1964 | Germany | 51/7 |

*Primary Examiner*—Harold D. Whitehead
*Attorney, Agent, or Firm*—David A. Burge

[57] ABSTRACT

Surfaces of an elongated, flexible substrate such as chain are finished by supporting successive loops of the substrate with lower portions of the loops depending into the receptacle of a vibratory finishing machine. Finishing media in the receptacle surrounds lower portions of the loops and imparts a finishing action to substrate surfaces as the receptacle is vibrated. Continuous finishing of an endless substrate is effected by feeding the substrate along a path defined by the successive loops.

15 Claims, 3 Drawing Figures

CHAIN FINISHING SYSTEM

CROSS REFERENCE TO RELEVANT PATENT

*Vibratory Finishing Machine,* U.S. Pat. No. 3,449,869 issued June 17, 1969 to J. F. Rampe, here the "Finishing Machine Patent", the disclosure of which is incorporated by reference.

BACKGROUND OF THE INVENTION

1. Field of the Invention

The present invention relates generally to the finishing of elongated, flexible substrates, and more particularly to the surface finishing of such substrates as chain.

2. Prior Art

Many surface finishing operations such as deburring, burnishing, descaling, cleaning and the like can be conducted expeditiously in a vibratory finishing machine. Such a machine includes a movably mounted receptacle and a drive system for vibrating the receptacle. One such machine is described in the referenced Finishing Machine Patent. Workpieces to be finished are loaded into the receptacle together with finishing media. A finishing action is imparted to the workpieces by vibrating the receptacle so that the mixture of workpieces and media is effectively maintained in a fluid state with smaller components of the mixture dispersed between larger components for impact. Impulse forces imparted to the mixture by the vibrating tub cause repeated impacts among the mixture components and cause the mixture to churn in a predictable manner as a finishing process is carried out.

Many elongated, flexible substrates require surface finishing to remove burrs, enhance their appearance, and/or ready them for the application of protective coatings. Steel chain, for example, needs to be descaled, smoothed and cleaned after its links have been welded and heat treated. Once the chain link surfaces are suitably smooth and clean, they are usually plated or otherwise protectively coated.

While vibratory finishing machines have been used to effect finishing operations on such elongated, flexible substrates as chain, only batch-type finishing operations have met with success. Lengths of the substrate are typically tied with wire to form bundles, and the bundles are finished one or a few at a time. Attempts made to devise a system that will permit the continuous finishing of elongated, flexible substrates such as chain have not met with success.

SUMMARY OF THE INVENTION

The present invention overcomes the foregoing and other drawbacks of the prior art, and provides a novel and improved system for the surface finishing of elongated, flexible substrates such as chain.

Surface finishing of an elongated substrate is effected by forming at least one substrate loop, lower portions of which depend into the receptacle of a vibratory finishing machine, and by vibrating the receptacle so that finishing media in the receptacle will surround and impart a finishing action to lower loop surfaces. Successive substrate portions are fed along the loop path for finishing.

In preferred practice, a plurality of substrate loops are formed, and the loops are supported side by side with their lower portions depending into the machine receptacle for finishing. This arrangement causes each substrate segment to pass through the finishing media a plurality of times as the substrate is fed along a path defined by the sequential loops, and permits the substrate to be finished more rapidly than is possible where only a single loop is employed.

An apparatus for carrying out the preferred practice of the present invention includes a plurality of axially spaced pulleys supported on a common shaft above the open top of a finishing machine receptacle. The pulleys are concurrently rotated by an adjustable, intermittent drive system. Successive substrate loops are supported on the pulleys with their lower ends extending into the finishing machine receptacle. As the pulleys are rotated by the drive system, the substrate is fed along a path defined by the successive loops for successive passes through the finishing media. Drive system speed is set such that the substrate is properly finished when it has completed its last pass though the media.

In preferred practice, a large diameter rod extends centrally through the receptacle, and the substrate loops are reeved loosely around the rod. The rod helps to retain the loops in a proper orientation during finishing and helps prevent tangling of adjacent substrate loops. Dividers may also be inserted in the receptacle to segregate adjacent loops and to help prevent their becoming entangled.

As will be apparent from the foregoing summary, it is a general object of the present invention to provide a novel and improved system for the surface finishing of elongated, flexible substrates such as chain.

These and other objects and a fuller understanding of the invention described and claimed in the present application may be had by referring to the following description and claims taken in conjunction with the accompanying drawing.

DESCRIPTION OF THE PREFERRED EMBODIMENT

Figure 1:
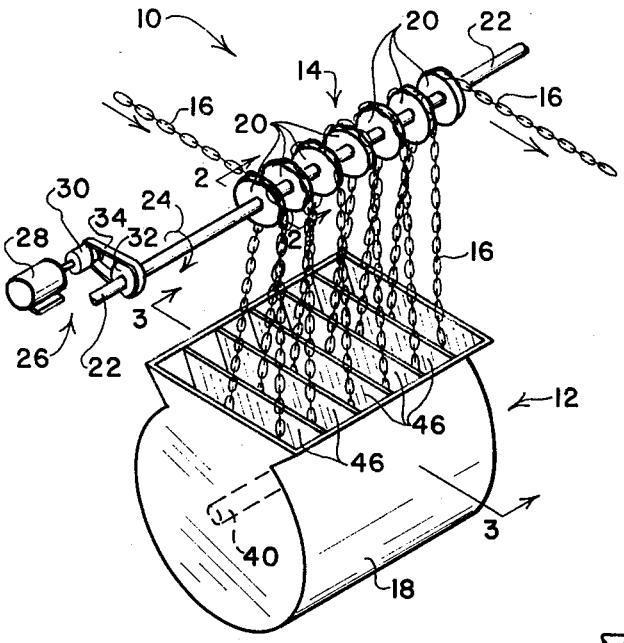
FIG. 1 is a perspective view of a portion of a finishing system embodying the present invention.

Referring to FIG. 1, an apparatus for finishing surfaces of an elongated, flexible substrate is indicated generally by the numeral 10. The apparatus 10 includes a vibratory finishing machine 12 and structure 14 for supporting loops of a substrate 16 for finishing by the machine 12.

The finishing machine 12 is preferably of the type described in the referenced Finishing Machine Patent. It has a receptacle 18 which is adapted to receive finishing media and workpieces to be finished, and structure (not shown) for movably supporting and vibratorily driving the recepatacle 18.

The substrate support structure 14 includes a plurality of axially spaced pulleys 20 which are carried on and are drivingly connected to a shaft 22. The shaft 22 is positioned above and extends parallel to the longitudinal axis of the receptacle 18. Bearings (not shown) journal the shaft 22 for rotation. The substrate 16 is a welded link, steel chain. Successive loops of the substrate 16 are reeved around and are supported at their upper ends by the pulleys 20. Lower ends of the substrate loops depend into the receptacle 18. When the shaft 22 is rotated in a direction indicated by arrow 24, portions of the substrate 16 are fed along a path defined by the successive loops into and out of the receptacle 18 a series of times to complete a surface finishing cycle.

A variable speed drive system 26 is provided to rotate the pulleys 20 and the shaft 22. The drive system 26 may include a variable speed motor, but preferably includes instead a constant speed, continuously running motor 28 which is intermittently drivingly coupled to the shaft 22 through a clutch 30. A drive pulley 32 is carried on the shaft 22. A belt 34 drivingly connects the clutch 30 and the pulley 34. By adjusting the length and frequency of the intervals during which the clutch 30 drivingly engages the motor 28 and the shaft 22, the resulting average speed of rotation of the shaft 22 can be accurately controlled throughout any desired range of speed adjustment.

Figure 2:
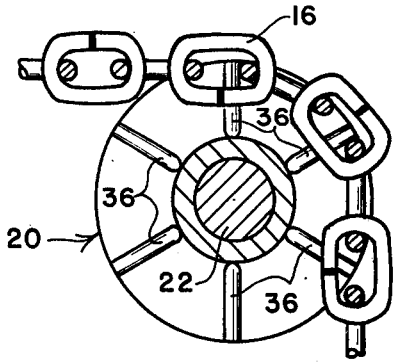
FIG. 2 is an enlarged sectional view as seen from a plane indicated by a line 2—2 in FIG. 1; and, FIG. 3 is an enlarged sectional view as seen from a plane indicated by a line 3—3 in FIG. 1.

Referring to FIG. 2, each of the pulleys 20 is provided with radially extending projections 36 on its inner surfaces. The projections fit between alternate links of the chain substrate 16 and establish a secure driving connection with the substrate. A secure driving connection is required to maintain substrate loops of constant length as the substrate 16 is fed through a finishing cycle.

Figure 3:
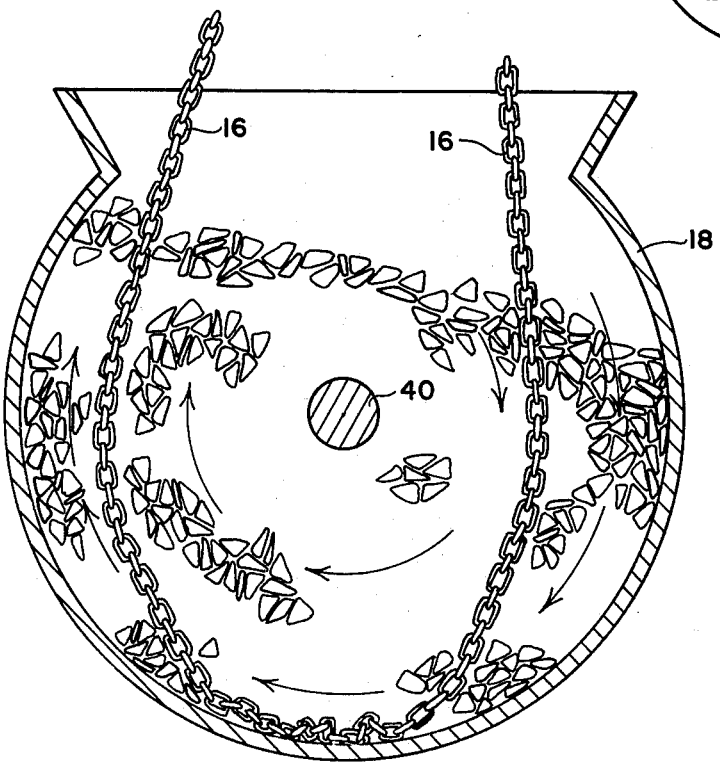

Referring to FIG. 3, a typical one of the substrate loops is shown as it feeds through the receptacle 18. The loops feed in the same direction as the finishing media rotates or churns in the receptacle 18. As shown in FIG. 3, both the substrate and the media move in clockwise directions.

In order to prevent entanglement of adjacent substrate loops and to help assure that the substrate follows a prescribed path of movement, lower portions of the substrate loops are reeved loosely around a rod 40. The rod 40 preferably has a diameter of about 2 inches and extends centrally through the receptacle 18 along the receptacle's longitudinal axis. Opposite ends of the rod 40 are supported by opposite ends of the receptacle 18.

Where the substrate being finished is chain, it is desirable for the substrate loops to be long enough for a length of each loop to lie loosely on the bottom of the receptacle 18. This arrangement permits adjacent links to move more freely relative to each other during finishing than can be achieved when the loops are held taut.

Referring again to FIG. 1, depending on the type of substrate being finished, it may be desirable to mount one or more dividers 46 in the receptacle to further assist in preventing entanglement of adjacent substrate loops and/or to divide the receptacle into separate compartments housing different types of finishing media.

In operation, loops of a substrate to be finished are fed slowly in a ratchet-like fashion by intermittently rotating the shaft 22. When the end of one substrate is reached, the beginning of a subsequent substrate is attached to it so the new substrate will thread itself onto the pulleys 20 and through the receptacle 18 without the need for operator assistance or machine down-time.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A method of finishing surface portions of an elongated, flexible substrate formed from a multiplicity of loosely interconnected links, comprising the steps of:

a. supporting at least one loop of the substrate such that lower portions of the loop depend into a quantity of finishing media contained in a vibratory finishing machine receptacle, with the loop being of sufficient length to let lower portions of the loop lie loosely on the bottom surface of the receptacle whereby adjacent links can move freely relative to each other;

b. vibrating the receptacle to impart a finishing action to its contents; and c. feeding successive segments of the substrate along a path of travel defined by the loop to effect surface finishing of such segments.

2. The method of claim 1 additionally including the step of reeving the loop around an elongated structure which extends substantially centrally through the receptacle.

3. The method of claim 1 wherein a plurality of successive substrate loops are arranged side-by-side and are supported with their lower portions depending into the finishing media, with each of the loops being of sufficient length to let lower portions of the loop lie loosely on the bottom surface of the receptacle whereby adjacent links can move freely relative to each other, and the step of feeding the substrate includes feeding the substrate along a path defined by the successive loops during finishing of the substrate.

4. The method of claim 3 additionally including the step of segregating at least selected portions of two adjacent substrate loops by providing divider means in the finishing machine receptacle.

5. The method of claim 1 wherein the at least one loop is supported on at least a pair of toothed pulleys which drivingly engage selected substrate links, the pulleys are supported on a common drive shaft, and the step of feeding the substrate is effected, at least in part, by rotating the drive shaft to concurrently drive the pulleys.

6. The method of claim 5 wherein the step of rotating the drive shaft is effected by an intermittent drive system which is adjustable to control the average speed of drive shaft rotation.

7. An apparatus for finishing surface portions of an elongated, flexible substate, comprising:

a. vibratory finishing means including a receptacle and a drive system for vibrating the receptacle to impart a finishing action to contents including finishing media within the receptacle;

b. support means for supporting at least one loop of an elongated, flexible substrate formed from a multiplicity of loosely interconnected links such that lower portions of the loop depend into a quantity of finishing media contained in the finishing means receptacle, with the loop being of sufficient length to let lower portions of the loop lie loosely on the bottom surface of the receptacle whereby adjacent links can move freely relative to each other; and c. feeding means for feeding successive segments of the substrate along a path of travel defined by the loop to effect surface finishing of such segments.

8. The apparatus of claim 7 wherein the support means includes at least a pair of pulleys supported on a common drive shaft, and the feeding means includes drive means for rotating the drive shaft to feed substrate around the pulleys.

9. The apparatus of claim 8 wherein the pulleys have toothed inner surface portions for drivingly engaging selected substrate links.

10. The apparatus of claim 8 wherein the drive means includes an intermittent drive which is adjustable to control the average speed of rotation of the drive shaft.

11. The apparatus of claim 7 additionally including elongated means extending centrally through and supported near opposite ends by the finishing means receptacle for loosely extending through the lower end of the substrate loop to keep the loop properly oriented in the receptacle.

12. The apparatus of claim 7 wherein:

a. the support means includes at least three pulleys supported at a location above the level of media in the receptacle;

b. at least two sequential side-by-side loops of substrate are reeved around and supported by the pulleys with lower portions of the loops submerged in the media, with each of the loops being of sufficient length to let lower portions of the loop lie loosely on the bottom surface of the receptacle whereby adjacent links can move freely relative to each other; and c. the feeding means includes drive means for concurrently rotating the pulleys to feed successive substrate segments along a path defined by the successive loops.

13. The apparatus of claim 12 additionally including partition means in the receptacle to segregate selected portions of adjacent substrate loops.

14. The apparatus of claim 12 additionally including bar means extending substantially centrally through the receptacle, paralleling the axes of rotation of the pulleys, and extending loosely through the lower end portions of the loops at a location submerged in the media.

15. An apparatus for surface finishing a substantially endless length of chain, comprising:

a. vibratory finishing means including a receptacle and a drive system for vibrating the receptacle to impart a finishing action to receptacle contents including finishing media;

b. pulley means rotatably supported at a location above the level of receptacle contents for supporting a plurality of side-by-side sequentially interconnected loops of chain with lower portions of the loops depending into the receptacle contents and being of sufficient length to let lower portions of the loop lie loosely on the bottom surface of the receptacle whereby adjacent links can move freely relative to each other;

c. guide means extending substantially centrally through the receptacle and loosely through lower portions of the chain loops to assist in maintaining a predetermined orientation of the lower loop portions in the receptacle; and, d. feeding means drivingly connected to the pulley means for rotating the pulley means to feed successive segments of the chain along a path of travel defined by the sequentially interconnected loops.

* * * * *